US011338993B2

(12) United States Patent
Moradi et al.

(10) Patent No.: US 11,338,993 B2
(45) Date of Patent: May 24, 2022

(54) DISCHARGING ELEMENT FOR DISCHARGING SUBSTANCES INTO A LIQUID

(71) Applicant: Moradi Consulting GmbH, Vienna (AT)

(72) Inventors: Shahriar Moradi, Hagenbrunn (AT); Lukas Rettenbacher, Vienna (AT)

(73) Assignee: Moradi Consulting GmbH, Vienna (AT)

( * ) Notice: Subject to any disclaimer, the term of this patent is extended or adjusted under 35 U.S.C. 154(b) by 867 days.

(21) Appl. No.: 15/540,629

(22) PCT Filed: Dec. 28, 2015

(86) PCT No.: PCT/AT2015/050330
§ 371 (c)(1),
(2) Date: Jun. 29, 2017

(87) PCT Pub. No.: WO2016/106436
PCT Pub. Date: Jul. 7, 2016

(65) Prior Publication Data

US 2017/0349369 A1 Dec. 7, 2017

(30) Foreign Application Priority Data

Dec. 30, 2014 (AT) ..... PCT/AT2014/050312

(51) Int. Cl.
*B65D 85/804* (2006.01)
*B65D 51/28* (2006.01)

(52) U.S. Cl.
CPC ..... *B65D 85/8055* (2020.05); *B65D 51/2878* (2013.01)

(58) Field of Classification Search
CPC B65D 85/8043; B65D 51/2878; B65D 51/28; B65D 51/2807; B65D 51/2857; B65D 51/2814; B65D 51/2821
(Continued)

(56) References Cited

U.S. PATENT DOCUMENTS 5,984,141 A * 11/1999 Gibler ..... A47J 41/0027 206/219
7,650,830 B1 1/2010 Lessis
(Continued)

FOREIGN PATENT DOCUMENTS

CN 101287662 A 10/2008
CN 102405179 A 4/2012
(Continued)

OTHER PUBLICATIONS

International Search Report of PCT/AT2015/050330, dated Mar. 18, 2016.
(Continued)

*Primary Examiner* — Tu B Hoang
*Assistant Examiner* — Alba T Rosario-Aponte
(74) *Attorney, Agent, or Firm* — Collard & Roe, P.C.

(57) ABSTRACT

A discharging element for discharging substances into a liquid is disclosed, wherein the discharging element is in the form of a capsule, wherein the capsule casing (1-3) encloses a fillable volume for substances to be discharged, the capsule casing is made of a liquid-tight material and has at least one first opening (7) and at least one second opening (8) which are arranged in such a way that, when liquid flows around the capsule, a greater flow velocity is present at a first opening (7) than at a second opening (8), wherein the first and second opening are connected to one another via the fillable volume, and wherein either the first opening (7) and the second opening (8) are located on one outer surface, or
(Continued)

wherein the surface normal of the capsule casing (1-3) at the location of the first opening (7) encloses an angle with the surface normal of the capsule casing at the location of the second opening (8).

4 Claims, 12 Drawing Sheets

(58) Field of Classification Search
USPC ..... 99/295, 494, 495; 222/129, 129.1, 135
See application file for complete search history.

(56) References Cited

U.S. PATENT DOCUMENTS

| | | | | |
|---|---|---|---|---|
| 7,681,492 | B2 | 3/2010 | Suggi Liverani et al. | |
| 8,511,465 | B2 | 8/2013 | Seelhofer | |
| 8,563,058 | B2 | 10/2013 | Roulin et al. | |
| 9,375,111 | B2 | 6/2016 | Deuber | |
| 10,039,410 | B2 | 8/2018 | Deuber | |
| 2004/0173102 | A1 | 9/2004 | Halliday et al. | |
| 2004/0208960 | A1 | 10/2004 | Marshall | |
| 2004/0262328 | A1* | 12/2004 | Nilsen | B65D 85/808 222/129 |
| 2006/0065127 | A1 | 3/2006 | Dalton et al. | |
| 2008/0202950 | A1* | 8/2008 | Anderson | B65D 51/2842 206/219 |
| 2008/0223485 | A1* | 9/2008 | Nyambi | B65D 51/2835 141/351 |
| 2008/0282909 | A1* | 11/2008 | Drebing | B26D 1/553 99/537 |
| 2008/0295699 | A1 | 12/2008 | Duineveld et al. | |
| 2009/0127274 | A1* | 5/2009 | Mueller | B65D 51/2864 220/789 |
| 2010/0012193 | A1 | 1/2010 | Anson et al. | |
| 2010/0025282 | A1 | 2/2010 | Ricotti et al. | |
| 2010/0154647 | A1 | 6/2010 | Skalski et al. | |
| 2011/0290678 | A1 | 12/2011 | Simonian et al. | |
| 2013/0200099 | A1* | 8/2013 | Abe | B65D 35/14 222/95 |
| 2014/0131302 | A1 | 5/2014 | Maloney et al. | |
| 2014/0361016 | A1 | 12/2014 | Moreau | |
| 2015/0328653 | A1* | 11/2015 | Minnette | B05B 11/048 222/213 |
| 2016/0167852 | A1 | 6/2016 | Moradi | |
| 2016/0207676 | A1 | 7/2016 | Moradi et al. | |
| 2016/0272387 | A1 | 9/2016 | Moradi et al. | |

FOREIGN PATENT DOCUMENTS

| | | | |
|---|---|---|---|
| CN | 103 420 024 | A | 12/2013 |
| EP | 1 579 792 | A1 | 9/2005 |
| EP | 1 580 144 | A1 | 9/2005 |
| EP | 1 775 234 | A1 | 4/2007 |
| PT | 22 36 437 | E | 4/2012 |
| WO | 02/096774 | A1 | 12/2002 |
| WO | 2009/073998 | A1 | 6/2009 |
| WO | 2010/118543 | A1 | 10/2010 |
| WO | 2015/039700 | A1 | 3/2015 |
| WO | 2015/039702 | A1 | 3/2015 |
| WO | 2015/039709 | A1 | 3/2015 |
| WO | 2015/188893 | A1 | 12/2015 |

OTHER PUBLICATIONS

National Aeronautics and Space Administration, Dynamic Pressure, 2 pages, https://www.grc.nasa.gov/WWW/K-12/airplane/dynpress.html, downloaded Sep. 15, 2020.
India Examination Report in 201717026723, dated Apr. 24, 2020.

* cited by examiner

DISCHARGING ELEMENT FOR DISCHARGING SUBSTANCES INTO A LIQUID

CROSS REFERENCE TO RELATED APPLICATIONS

This application is the National Stage of PCT/AT2015/050330 filed on Dec. 28, 2015, which claims priority under 35 U.S.C. § 119 of PCT/AT2014/050312 filed on Dec. 30, 2014, the disclosure of which is incorporated by reference. The international application under PCT article 21(2) was not published in English.

FIELD OF THE INVENTION

The present invention relates to a discharging element for discharging substances into a liquid,

- wherein the discharging element is in the form of a capsule,
- wherein the capsule casing encloses a fillable volume for substances to be discharged, the capsule casing is made of a liquid-tight material and has at least one first opening and at least one second opening, and
- wherein the first and second opening are connected to one another via the fillable volume.

In principle, the discharging element can be used to discharge a wide range of substances into a liquid, such as for discharging flavor substances into a beverage or for discharging fertilizer into the liquid in a watering can or in a garden hose.

Such a discharging element can in particular be inserted in a closure cap of a liquid container in order to discharge the substances to the liquid that passes from the liquid container through the closure cap into the mouth of the drinker.

Such a closure cap, preferably a screw closure cap, may be designed to be placed onto a liquid container, preferably onto a bottle, particularly preferably onto a PET bottle, wherein the closure cap comprises an outlet opening, preferably a reclosable outlet opening, and an accommodating element which together with the closure cap forms a common accommodating volume for accommodating the at least one discharging element. The closure cap may be openable in the sense that an access to the accommodating volume is formed in order to be able to insert the at least one discharging element into the accommodating volume or to be able to remove said discharging element from the accommodating volume, wherein the accommodating element is permeable to a liquid in order to enable the at least one discharging element to make contact with the liquid. Such closure caps are disclosed for example in PCT/EP2013/069588, in PCT/EP2013/069628, in PCT/EP2013/071276 or in PCT/EP2014/065516.

The invention also encompasses a system consisting of a closure cap and at least one discharging element, and also a method for discharging substances from a discharging element.

PRIOR ART

For preparing beverages, capsules which are filled with substances to be discharged are known for instance from US 2010/0154647 A1, wherein a first opening and a second opening are provided opposite one another and the substances to be discharged are conveyed out of the capsule by a liquid which is mechanically pressurized and which flows at least partially through the capsule. For preparing coffee, there is known from WO 2010/118543 A1 a cube-shaped or cuboid-shaped capsule which, prior to a brewing operation, is perforated on two sides so that the brewing liquid flows under pressure through the capsule. US 2010/0025282 A1 discloses a cube-shaped capsule for aromatic substances, with internal structures which lengthen the connecting path between the two opposite openings, wherein, by means of the openings, liquid is conducted through the capsule in order to produce an aromatized beverage.

Drinking bottles, in particular drinking bottles having a closure cap, are known which make it possible to carry liquids on the go or when playing sport. Since drinking bottles usually have no devices able to produce hot or pressurized water, capsules where liquid must be conducted through the capsule cannot be used for drinking bottles. Drinking bottles usually have threads, onto which the closure caps are screwed. The threads are standardized and the number of different standardized threads for said drinking bottles is small. On the one hand, these bottles can be pre-filled, for example with mineral water, which may also contain added flavor substances, or with an isotonic beverage. On the other hand, these may be bottles which are intended to accommodate a liquid that is mixed as desired by the user. Besides fruit juice syrups, in particular effervescent powders or tablets are available for this scenario.

In both cases, it is disadvantageous that the specific beverage mixture is fixed for the user for the entire duration of consumption of the beverage, that is to say between the start and end of consumption of the beverage. In other words, the taste can no longer be changed during consumption of the beverage since the liquid still present in the bottle has only the originally selected taste.

However, the desired taste may change between the start and end of consumption of the beverage. For example, if the user has decided on a non-isotonic beverage and would then like an isotonic beverage after a certain period of time, during which he has taken part in sport for example, this is likewise no longer possible with the liquid still present in the bottle.

In addition, in the case of beverage preparation by means of effervescent tablets, the use of chemicals is necessary to dissolve the effervescent tablet. In other words, the use of purely natural substances for beverage preparation is not possible in this case, which is to be regarded as a disadvantage.

Incomplete dissolution of the tablet may be associated with a non-optimally selected dosage, in particular with an excessively high concentration of the powder or tablet. However, it is not always easy to adhere to the correct dosage since, strictly speaking, the precisely available amount of liquid must be taken into account when mixing the powder or tablet with the liquid (usually water).

These disadvantages can be remedied at least in part if a tablet which contains the substances to be discharged is stored in the closure cap and therefore comes into contact with the liquid from the liquid container only when drinking, as is the case in the aforementioned PCT applications PCT/EP2013/069588, PCT/EP2013/069628, PCT/EP2013/071276 or PCT/EP2014/065516. In addition, US 2010/0012193 A1 describes a liquid container having a closure cap which is formed in three parts and which has a tablet container, a container lid and a closure cap closure.

However, it is disadvantageous that not all substances to be discharged are produced in the form of a solid, for example as a tablet. Even if this were the case, the problem may still exist that, nevertheless, insufficient dissolution of the substances present in a solid is achieved simply as a result of drink liquid circulating around said solid.

OBJECT OF THE INVENTION

It is therefore an object of the present invention to provide an alternative discharging element which is not based on the dissolution of a solid. At the same time, the admixing of flavor substances and/or nutrients and/or dietary supplements and/or medicinal active ingredients with a liquid circulating around the discharging element should be achieved by the discharging element. In particular, it should also be easy to change the flavor substances and/or nutrients and/or dietary supplements. Furthermore, dosage problems should be avoided, in particular excessively high concentrations of flavor substances and/or nutrients and/or dietary supplements in the liquid.

SUMMARY OF THE INVENTION

To achieve these objects, it is provided that the discharging element is in the form of a capsule, wherein the capsule casing encloses a fillable volume for substances to be discharged, the capsule casing is made of a liquid-tight material and has at least one first opening and at least one second opening which are arranged in such a way that, when liquid flows around the capsule, a greater flow velocity is present at a first opening than at a second opening, wherein the first and second opening are connected to one another via the fillable volume.

In particular, said objects are achieved by a discharging element according to the invention. It is provided that the first opening and the second opening are arranged in such a way that, when liquid flows around the capsule, a greater flow velocity is present at a first opening than at a second opening, and that the liquid draws a liquid substance out of the capsule by utilizing the dynamic pressure, and in that either the capsule casing comprises a plurality of surfaces which at least on the outer side of the capsule casing are separated from one another by edges, wherein the first opening and the second opening are located on one outer surface, or in that the surface normal of the capsule casing at the location of the first opening encloses an angle with the surface normal of the capsule casing at the location of the second opening, wherein the fillable volume contains substances to be discharged which are in the form of a liquid.

The first embodiment variant provides that an outer surface, which is formed by edges of the capsule casing on the outer side thereof, has at least one, but also a plurality of, in particular all, first openings. The same outer surface has at least one second opening, but may also have a plurality of, in particular even all, second openings. This outer surface may be flat, but also curved.

The second embodiment variant provides—independently of a division of the outer side of the capsule casing into a plurality of outer surfaces—that the surface normal(s) of the first opening(s) encloses an angle with the surface normal(s) of the second opening(s). This is not the case when the first and second opening(s) are located on the same flat surface, which is indeed covered by the first embodiment variant in accordance with the invention. This is also not the case when the first and second opening(s) are located opposite one another, because then the surface normals coincide, as is the case in US 2010/0154647 A1 or in US 2010/0025282 A1. Openings located opposite one another are in fact only advantageous when liquid enters the capsule from outside through an opening, flows through the capsule, picks up the substances to be discharged and leaves again through the other opening. This is not desired in the present invention. In the second embodiment variant, the capsule in any case contains a substance to be discharged which is in the form of a liquid. In the first embodiment variant, where at least one first and one second opening are located on the same outer surface, the capsule in the ready-to-operate state is likewise generally filled with a liquid.

The capsule according to the invention utilizes the pressure difference of a fluid flow or of a fluid jet to generate a pump action similar to a jet pump. In doing so, the liquid, for example water, flowing past the capsule or flowing around the capsule draws a liquid substance out of the capsule by utilizing—in particular exclusively—the dynamic pressure and mixes with said substance. Since the substance is already in liquid form, the step of dissolving the substance in the liquid flowing around is omitted. The substance to be discharged into the liquid can be changed by replacing the capsule.

The dose of the discharged substance depends not only on the effective cross-sectional area and the shape of the openings but also, almost exclusively, on the flow velocity of the liquid. Since the capsule is generally used in a closure cap which has a defined cross-section through which the flow can pass, no large variations in the flow rate of the liquid are possible, and hence also no overdosing of the discharged substance.

The capsule according to the invention is based on a similar principle to Venturi injectors; in the case of Venturi injectors, however, both fluids are continuously conveyed, but the capsule can always provide only a limited amount of substances to be discharged. When the capsule is used in conjunction with a liquid container, however, only a limited amount of circulating liquid is available: the amount of liquid circulating around the capsule is limited by the volume of the container to which the capsule is applied, for example by means of a closure cap. In other uses of the capsule, for instance in conjunction with a garden hose, the amount of circulating liquid is not limited.

With the capsule according to the invention, a liquid which is located in the capsule can be steadily dosed into another liquid that is moving. The at least one first opening and the at least one second opening are flowed around at different velocity on account of their shape and/or their position. The shape of the opening can influence the flow velocity in so far as the opening may be constructed in a flow-promoting manner by having for instance a type of flow channel, for example in the form of depressions in the surface or walls on the surface of the capsule. In principle, any constriction leads to faster flow and lower pressure, according to the known mode of operation of a diffuser.

The different flow velocities at the first and second opening lead to a pressure difference between the two openings. The opening with faster circulation discharges liquid from the interior of the capsule into the circulating liquid, while the opening with slower circulation receives circulating liquid. As a result, the liquid located in the capsule is continuously discharged and replaced by the circulating liquid.

In order that a pressure difference can develop between the first and second opening, the first and second opening must be connected to one another via the fillable volume. The fillable volume should therefore not contain any walls which separate the first and second opening from one another in a liquid-tight manner. Usually, the first and second opening are also connected to one another via the medium flowing around. However, the pressure difference would also develop if the pressure compensation opening were to be connected to the outside air, and this would then correspond to the principle of a conventional jet pump.

The first and second opening(s) of the capsule are pre-manufactured. They are not, as in WO 2010/118543 A1, produced only at the time of use by perforating the capsule. In the case of the capsule according to the invention, perforation would moreover not be possible since the capsule or the capsule casing is generally rigid in order to ensure a defined shape and thus defined flow conditions for the mode of operation according to the invention. Such a rigid or thick wall of the capsule casing cannot easily be pierced.

The openings may have different sizes, namely the first openings may have a different size than the second openings. In the case of a plurality of openings, differences in size may additionally or alternatively exist within the plurality of first openings and/or within the plurality of second openings. By virtue of the size and/or the shape of the openings, it is possible to define how quickly and/or for how long liquid will be discharged from the capsule to the liquid flowing around. For water, typical diameters of first and second openings lie in a range of 0.001-3 mm or greater, in particular 0.01-2 mm, particularly preferably 0.3-1 mm. The diameters generally depend on the viscosity of the liquids. The openings may in principle be provided at any location on the capsule. The first and second opening may have the same shape and size.

In one possible embodiment, precisely one first and precisely one second opening are provided. Depending on the viscosity of the liquid to be discharged, however, it may be useful to provide a plurality of smaller first (and/or second) openings instead of one relatively large first (and/or second) opening. For instance, a plurality of smaller openings could be provided instead of a larger opening in the case where a larger opening might leak.

A mixing of the liquid to be discharged with the circulating liquid already sucked into the capsule can be increased or reduced by the internal design of the capsule. To reduce the mixing, it may be provided that the capsule has, in the fillable volume, internal structures for lengthening the connecting path, in particular even a bend, between the first and second opening. To increase the mixing, such internal structures in the capsule would be omitted, or use would be made of internal structures having a different form which promote the mixing, such as a vortex generating means for example.

Since the first and second opening are generally not large enough to fill the capsule rapidly, it may be provided that the capsule is formed in two parts. Then one part of the capsule can be filled, whereas another part of the capsule closes the latter. One part of the capsule may thus have the concave shape of a container, while the other part forms a flatter lid. In particular, the two parts may be connected to one another by a form fit, for instance by plugging one part into the other part.

The capsule may be manufactured from plastic, for example by injection molding.

The capsule may be of any shape, but it must be adapted to the shape and dimensions of a closure cap if it is to be accommodated in a closure cap. Internal structures of the closure cap, such as valves or mouthpieces, must also be taken into account. The capsule may for instance be round, half-moon-shaped, crescent-shaped (for placement around a valve or around a mouthpiece) or angular. Half-moon-shaped means that the capsule has either the ideal shape of a semicircle or a shape based on the semicircle, such as for instance a large "D" where the tips of the semicircle normal to the straight side of the semicircle are cut off. Crescent-shaped means that either there is the ideal shape of a crescent, where part of one circular face is removed by a second circular face, or a shape based on the crescent shape, where the outer circular face is partially straightened.

To ensure different flow velocities between the first and second opening, it may be provided that the surface normal of the capsule casing at the location of the first opening encloses an angle with the surface normal of the capsule casing at the location of the second opening. This is generally already achieved by a particular distance between the first and second opening, for instance if the capsule casing is curved on the outside.

It may be provided that the capsule casing comprises a plurality of surfaces which at least on the outer side of the capsule casing are separated from one another by edges, wherein the first opening is arranged on a different outer surface than the second opening. The outer surfaces may be flat or curved. However, it is also possible that the two openings are located on one outer surface or side, that is to say the first opening(s) is (are) arranged on the same outer surface as the second opening(s). In addition, it may be provided that all first and second openings are located on just one outer surface.

By way of example, the capsule casing may have a largely flat bottom surface, a largely flat top surface parallel to the bottom surface, and a lateral surface joining the bottom surface and top surface. The capsule casing would therefore have substantially the shape of a straight prism. The bottom surface and top surface could be congruent; the lateral surface could be normal to the bottom surface and top surface. The bottom surface and top surface could have the shape of a circle, a semicircle, a crescent, etc.

In the case of a capsule casing having a largely flat bottom surface, a largely flat top surface parallel to the bottom surface, and a lateral surface joining the bottom surface and top surface, it may be provided that the first opening is provided in the lateral surface and the second opening is provided in the top surface. In this case, a higher flow velocity would be present at the lateral surface than at the top surface, so that liquid is sucked out of the capsule through the first opening, while some of the circulated fluid is sucked into the capsule through the second opening in the top surface.

In order that there is a greatest possible distance between the first and second opening, it may be provided in this case that the first opening is arranged closer to the bottom surface than to the top surface.

However, the first opening (that is to say at least one, or else a plurality, in particular all) and the second opening (that is to say again at least one, or else a plurality, in particular all) may also be provided in the top surface.

For instance, it may be provided that one second opening is arranged between two first openings, the second opening being arranged in particular centrally in relation to the top surface. By way of example, the two first openings and the one second opening may be located on a straight line.

If the second opening is provided close to the boundary of the top surface, this has the advantage that reflux forms less easily, since the opening points upward.

The bottom surface and the top surface may have at least approximately the shape of a semicircle or crescent. This means that the bottom surface and top surface have either the ideal shape of a semicircle or a shape based on the semicircle, such as for instance a large "D" where the tips of the semicircle normal to the straight side of the semicircle are cut off. Approximately crescent-shaped means that either there is the ideal shape of a crescent, where part of one circular face is removed by a second circular face, or a shape based on the crescent shape, where the outer circular face is partially straightened.

In order to reduce the mixing of a liquid circulating around the capsule with the liquid with which the capsule was originally filled, there may be provided, in the fillable volume of the capsule, internal structures for lengthening the connecting path between the first and second opening in such a way that a labyrinth-like connecting path is created between the first and second opening. However, the labyrinth-like internal structures can also easily partially separate first and/or second openings from other fillable volume areas in the capsule volume in order to reduce a mixing of a liquid circulating around the capsule with the liquid with which the capsule was originally filled, or an excessively rapid discharging of substances from the capsule into the circulating liquid.

For instance, the internal structures may comprise flat walls which—particularly in the case of a capsule having a parallel top surface and bottom surface—run normal to the top surface and bottom surface. For example, the flat walls may form a labyrinth or a meandering connecting path, in particular between the first and second opening.

The capsules according to the invention are generally delivered to an end user in an already filled form, so that the invention also encompasses a discharging element where the fillable volume contains substances to be discharged which are in the form of a liquid. In this case, the viscosity of the liquid can be adapted in such a way that, for a given capsule and given openings, a desired discharge rate or discharge duration is achieved. For the use of the capsule to prepare a beverage, these liquids can in principle be all food-grade substances in liquid form and in particular may contain the following substances or consist of the following substances: fruit syrups, flavored sugar solutions, dietary supplements, medicinal active ingredients, concentrated isotonic beverage preparations, flavor-imparting substances, flavorings. For other uses of the capsule, for instance for discharging fertilizer, use can also be made of non-food-grade liquids.

In order to be able to discharge at a varying rate any active ingredient which is contained in the liquid of the capsule, it may be provided that the liquid contains an active ingredient gradient. This means that the active ingredient is not evenly distributed in the fill liquid of the capsule, but rather there are partial volumes having a higher active ingredient density and partial volumes having a lower active ingredient density. For instance, a high active ingredient density in the fill liquid could exist close to the first opening, in order to release more active ingredient at the start of the drinking process than later. Or the situation could be reversed so that less active ingredient is discharged at the start than later. If a plurality of active ingredients are contained in the fill liquid, these could have different active ingredient gradients. A first active ingredient could for example have a higher concentration than a second in one partial volume of the capsule, while the second active ingredient has a higher concentration than the first in another partial volume.

The discharging element may be designed for use in a closure cap for a liquid container, in particular in that it has the necessary external dimensions, and/or in that it already has the necessary openings since closure caps generally do not have any piercing mechanisms, and/or in that it has no openings which are large enough and/or arranged in such a way that liquid flows through the capsule, as would be the case with pressurized coffee capsules.

It is also conceivable that filled capsules are delivered to the end user together with a closure cap. The invention thus also encompasses a discharging element with a closure cap for a liquid container, wherein the discharging element is arranged in the closure cap, in particular a discharging element for discharging substances into a liquid, wherein the discharging element is in the form of a capsule, wherein the capsule casing encloses a fillable volume for substances to be discharged, the capsule casing is made of a liquid-tight material and has at least one first opening and at least one second opening which are arranged in such a way that, when liquid flows around the capsule, a greater flow velocity is present at a first opening than at a second opening, wherein the first and second opening are connected to one another via the fillable volume, wherein the discharging element is arranged in a closure cap. The end user then need only screw the closure cap onto a liquid container and can immediately partake of the liquid from the liquid container, enriched with the substances from the capsule.

Particularly in the case of a capsule having a largely flat bottom surface, a largely flat top surface parallel to the bottom surface, and a lateral surface joining the bottom surface and top surface, the top surface of the capsule may be directed toward the outlet opening of the closure cap. If the closure cap has—in particular likewise flat—boundary surfaces in its interior, onto which the bottom surface of the capsule can be placed and/or which bear against the top surface (or are at only a small distance from the top surface), it is ensured that the capsule retains its position in the closure cap in all positions of the closure cap and thus always approximately the same flow conditions in the liquid flowing from the liquid container through the closure cap and around the capsule to the mouthpiece (or outlet opening) of the closure cap.

The present invention thus encompasses a method for discharging substances from a discharging element according to the invention, in which liquid flows around the capsule. Substances, in particular flavor substances and/or nutrients and/or dietary supplements and/or medicinal active ingredients, are discharged into the liquid flowing around. Nutrients include carbohydrates, fats, fiber, protein, minerals and vitamins. If a large number of carbohydrates, minerals and vitamins are released, it is thus possible to produce an isotonic beverage.

A mixing with the liquid thus takes place just before the user actually drinks the mixture. An excessively high concentration of the desired substances in the liquid can thus in principle be avoided.

In one embodiment of the method, the capsule is arranged in a closure cap which closes a liquid-filled container, and liquid from the container flows around the capsule as a result of tilting of the container, for instance in the drinking position. The flow of liquid around the capsule is at least aided by the drinker while drinking. In other words, the flow around the capsule is at least increased or perhaps even generated by the drinker sucking the liquid.

The closure cap is preferably a screw closure cap which fits on all standardized water bottles, or else the few different standardized bottle thread types can be mastered with a few different closure caps. The closure cap is usually provided with a mouthpiece which closes the outlet opening of the closure cap and can be moved from a closed position into a released position, preferably by displacing the mouthpiece. In the closed position, no liquid can pass via the mouthpiece through the closure cap. In the operating position, the closure cap thus enables secure storage of the liquid in the liquid container, even when the latter is being transported or when the user is carrying it while playing sport. In the released position, liquid can pass via the mouthpiece through the closure cap and the user is able to drink.

BRIEF DESCRIPTION OF THE FIGURES

The invention will now be explained in greater detail on the basis of exemplary embodiments. The drawings are given by way of example and are intended to illustrate the concept of the invention, but without limiting it any way.

In the drawings.

WAYS OF IMPLEMENTING THE INVENTION

Figure 1:
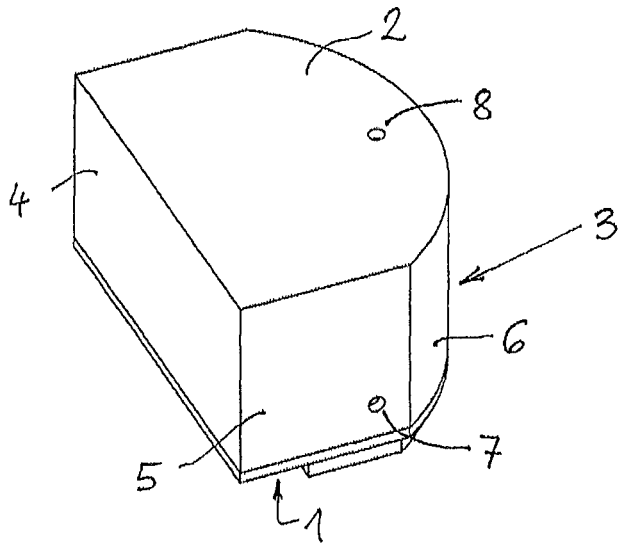
FIG. 1 shows an axonometric view of a capsule according to the invention.
Figure 27:
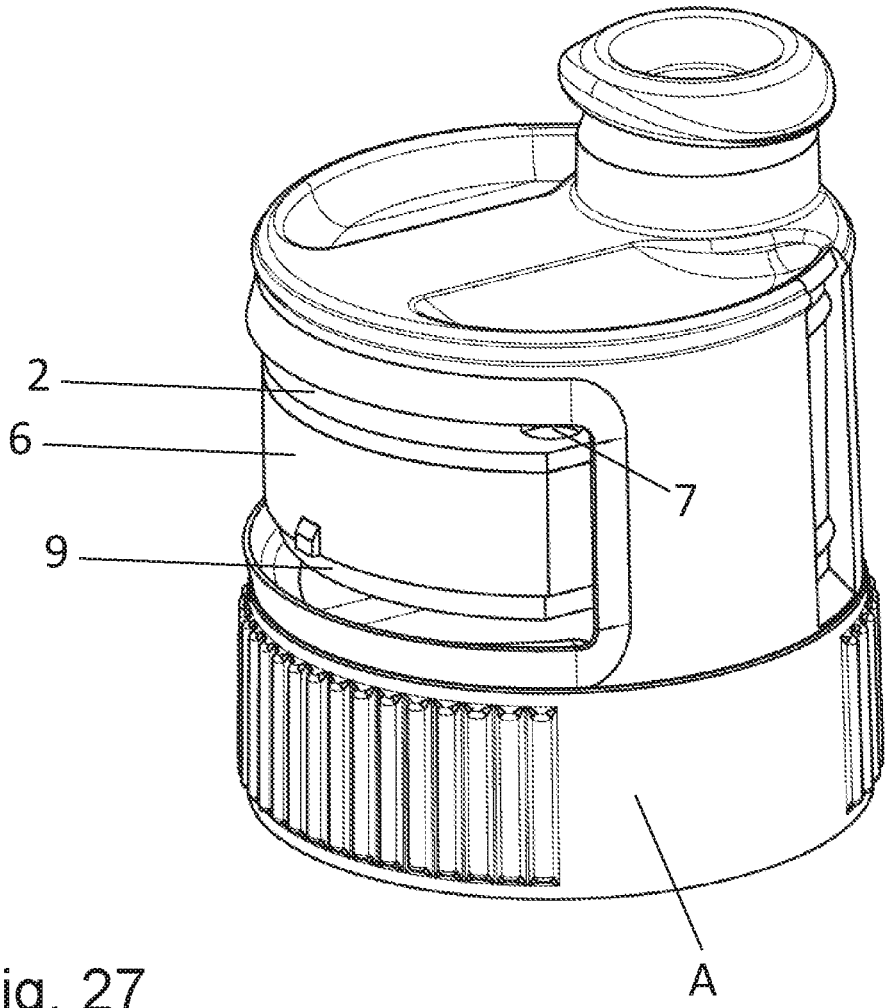
FIG. 27 shows a discharging element in a closure cap.

FIG. 1 shows a capsule according to the invention, the capsule casing of which is configured substantially as a straight prism and has a bottom surface 1, a top surface 2, and a lateral surface 3 joining said surfaces. The bottom surface 1 and the top surface 2 are congruent, are oriented parallel to one another and each have the shape of a rectangle, one longer side of which is adjoined by a circle segment. The curved region of the capsule could be supported on a correspondingly shaped inner wall of the closure cap A shown in FIG 27. Likewise, the longer straight side could be supported on a correspondingly shaped inner wall or on correspondingly shaped internal structures of a closure cap A.

The lateral surface 3 is normal to the bottom surface and top surface 1, 2 and consists of one long rectangle 4, two short rectangles 5 and a portion 6 of a cylindrical surface. In the visible short rectangle 5, a first opening 7 is provided close to the bottom surface 1 (at a distance therefrom of approximately two to three times the diameter of the opening 7) and the portion 6 (at a distance of approximately two to three times the diameter of the opening 7 from the bottom surface 1). No opening is provided in the non-visible short rectangle. In the top surface 2, a second opening 8 is provided approximately centrally in the circle segment, at a distance of approximately two to three times the diameter of the opening 8 from the edge where the top surface 2 meets the portion 6. The circle segment of the bottom surface and top surface 1, 2 has approximately half the width of the rectangle of the bottom surface and top surface 1, 2. This width is measured from left to right in FIGS. 1-3. The two openings 7, 8 are of equal size here and are circular in shape.

Figure 2:
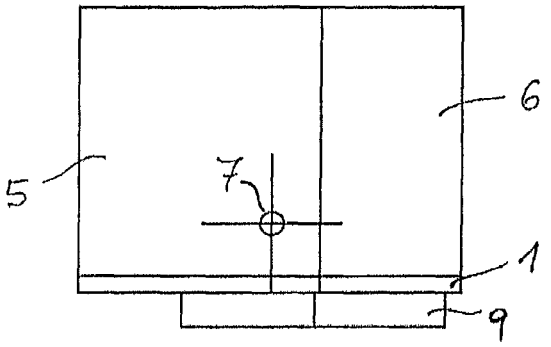
FIG. 2 shows a side view of the capsule of FIG. 1.

It can be seen in FIG. 2 that the bottom surface 1 has, inside its outer edge, a lowering toward the outside in the form of a base 9, which runs at a right angle to the rest of the bottom surface 1. Said base 9 serves for inserting the capsule into a depression in a closure cap which corresponds to the base 9.

Figure 3:
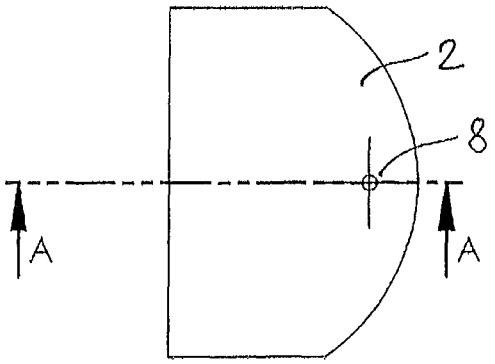
FIG. 3 shows a plan view of a capsule of FIG. 1.

The plan view of the capsule in FIG. 3 shows the shape of the top surface 2 and the arrangement of the second opening 8 on the top surface. The capsule casing consisting of bottom surface 1, top surface 2 and lateral surface 3 is (apart from the opening 7) symmetrical in relation to a plane which runs normal to the plane of the drawing through the dash-dotted line.

Figure 4:
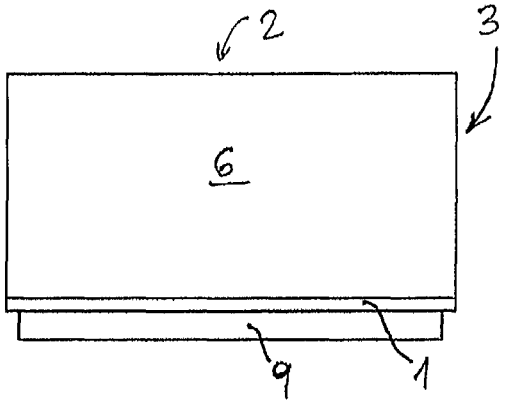
FIG. 4 shows a front view of a first variant of a capsule of FIG. 1.
Figure 5:
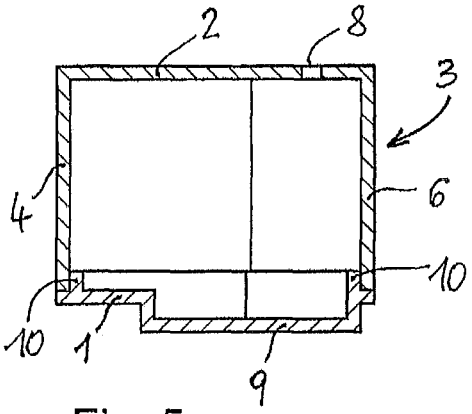
FIG. 5 shows a sectional view of the capsule of FIG. 4 along the section line A-A in FIG. 3.
Figure 6:
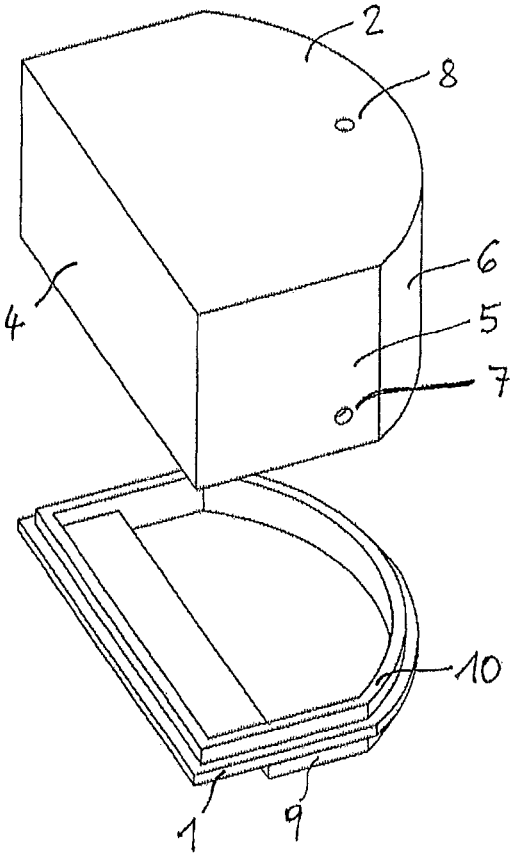
FIG. 6 shows an axonometric view of an open capsule of FIG. 4, without internal structures.

FIGS. 4-6 show a first embodiment of the invention according to FIGS. 1-3, in which no internal structures are provided in the capsule.

FIG. 4 shows the front view of the capsule of FIG. 1, in which the portion 6 of the lateral surface 3 and also the base 9 of the bottom surface 1 are shown.

FIG. 5 shows a sectional view of the capsule along the section line A-A in FIG. 3. The capsule is formed in two parts, wherein the bottom surface 1 with its base 9 forms the first part and the top surface 2 with the lateral surface 3, that is to say with the long rectangle 4, the two short rectangles 5 and the portion 6 of the cylindrical surface, forms the second part, see in this regard also FIG. 6, which shows the capsule in the open state.

On its side directed toward the interior of the capsule, the bottom surface 1 has a peripheral web 10 which is located inside the outer edge of the bottom surface 1. The distance of the web 10 from the outer edge of the bottom surface 1 is such that the lateral surface 3 of the second part of the capsule ends flush with the outer edge of the bottom surface 1. In the region of the circular outer edge of the bottom surface 1, the web 10 forms the continuation of the wall of the base 9.

The fillable volume of the capsule is created from the sum of the volumes of the upper part, which consists of the top surface 2 and lateral surface 3, and of the lower part, which consists of the bottom surface 1 and the base 9. In FIG. 5, the cross-section of the fillable volume lies within said elements.

FIGS. 7-10 show a second embodiment of the invention according to FIGS. 1-3, in which internal structures are provided in the capsule. FIGS. 7-10 correspond to FIGS. 4-6, but internal structures are provided on the bottom surface 1, that is to say on the first part of the capsule. The second part of the capsule, comprising the top surface 2 and the lateral surface 3, is the same as in FIGS. 4-6.

Figure 7:
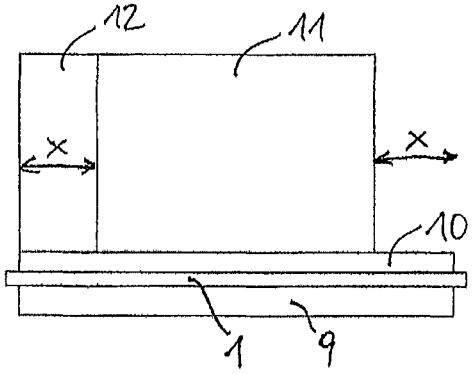
FIG. 7 shows a rear view of a lower part of a second variant (with internal structures) of a capsule of FIG. 1.
Figure 8:
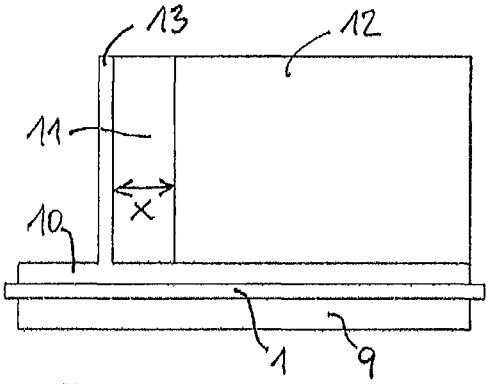
FIG. 8 shows a front view of a lower part of a capsule of FIG. 7.
Figure 9:
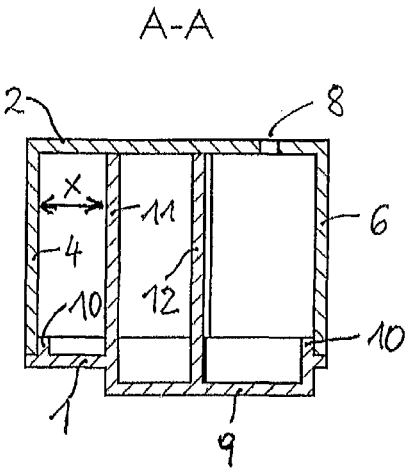
FIG. 9 shows a sectional view of the capsule of FIG. 7 along the section line A-A in FIG. 3.
Figure 10:
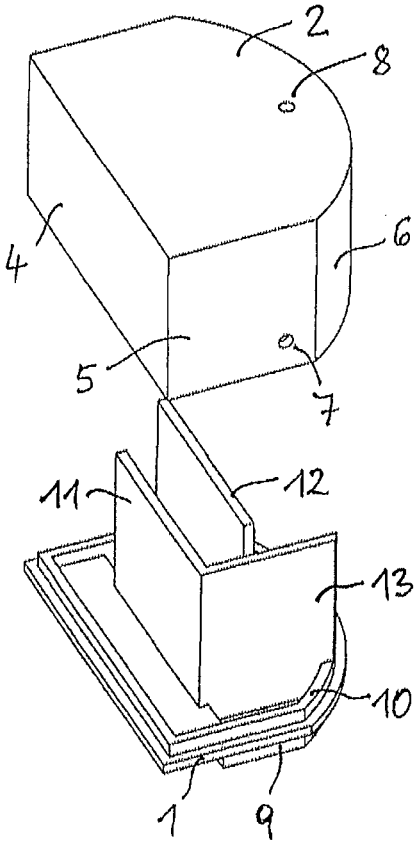
FIG. 10 shows an axonometric view of an open capsule of FIG. 7.

In FIG. 7, the bottom surface 1 can be seen from the rear, that is to say from the left in FIG. 10. In FIG. 8, the bottom surface 1 can be seen from the front, that is to say from the right in FIG. 10. FIG. 9 is a sectional view of the capsule along the section line A-A in FIG. 3. FIG. 10 shows the open capsule.

The internal structures consist of three flat walls 11-13. Two walls 11, 12 run parallel to the long edge of the bottom surface 1. One wall 13 runs normal to the other two walls 11, 12 and adjoins the wall 11 at a right angle thereto.

The wall 11 is arranged parallel to the long straight edge of the bottom surface, at a distance x therefrom. It is shorter than the long straight edge of the bottom surface 1, namely likewise by approximately the distance x at both sides, and is arranged centrally in relation to the long straight edge of the bottom surface 1. Here, the wall 11 forms a straight continuation of the wall of the base 9. The wall 11 is so high that it extends as far as the top surface 2 in the closed state of the capsule.

The wall 12 is arranged parallel to the wall 11, inside the wall 11 and approximately at a distance x therefrom. It is the same width as the wall 11 but is shifted parallel to the long straight edge of the bottom surface 1 right to the boundary of the bottom surface 1 so that the wall 12 in the closed state of the capsule extends as far as the lateral surface 3, namely as far as the short rectangle 5 (not visible in FIG. 10). The wall 12 is so high that, in the closed state of the capsule, it extends from the bottom surface 1, more precisely the bottom surface of the base 9, to the top surface 2.

The wall 13 is arranged normal to the wall 12, approximately at a distance x therefrom, and adjoins the wall 11 at a right angle. The wall 13 is so wide that the wall 13 in the closed state of the capsule extends as far as the lateral surface 3, namely as far as the curved portion 6. The wall 13 is so high that, in the closed state of the capsule, it extends from the bottom surface 1, or the bottom surface of the base 9, to the top surface 2.

The three walls 11-13 thus form a channel having a width that corresponds approximately to the distance x. The channel is closed at the top by the top surface 2 and at the bottom by the bottom surface 1 or the base 9 thereof. Said channel has the form of a labyrinth or two meanders and, in the closed state of the capsule, runs from the first opening 7 first outside of the wall 13 parallel to the wall 13 (between wall and short rectangle 5), then, after changing direction through 90°, outside of the wall 11 along the wall 11 (between wall 11 and long rectangle 4), then, after changing direction through 180°, between the wall 11 and the wall 12, then a further change in direction through 180° takes place along the wall 13, so that the channel finally ends between the wall 12 and the portion 6. The second opening 8 is located in the top surface 2 in this region. In this way, the connecting path that a liquid can take between the first opening 7 and the second opening 8 is significantly lengthened, for instance 2-fold or 4-fold, relative to the direct connection (air route) between the first opening 7 and the second opening 8.

Figure 11:
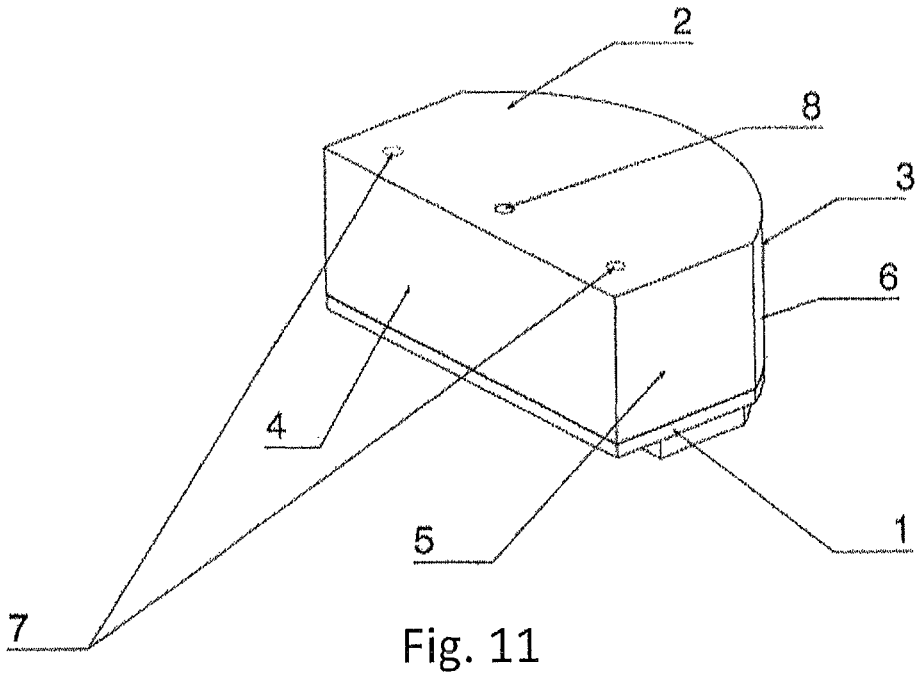
FIG. 11 shows an axonometric view of a second capsule according to the invention.
Figure 12:
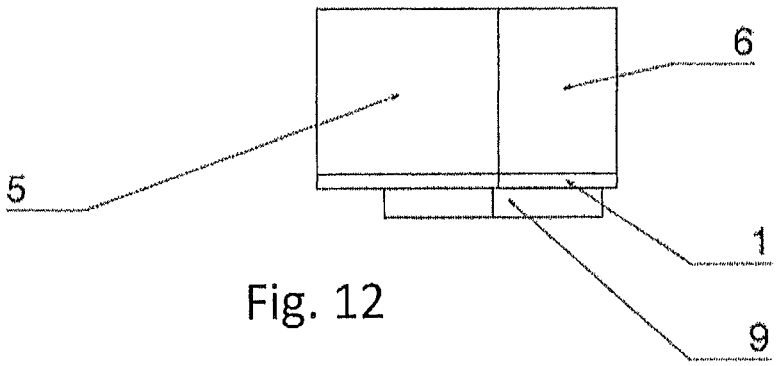
FIG. 12 shows a side view of the capsule of FIG. 11.

FIG. 11 shows a second capsule according to the invention, which apart from the openings 7, 8 is configured in a manner identical to that in FIGS. 1-10. Everything that has been stated in relation to FIGS. 1-10, apart from that concerning the openings 7, 8, therefore also applies to FIGS. 11-18. While in the first capsule shown in FIGS. 1-10 a total of just two openings are provided, in the second capsule shown in FIG. 11 a total of three openings are provided, all of which are located in one outer surface, namely in the top surface 2. In FIG. 11, no opening is provided in the visible short rectangle 5 or in the non-visible short rectangle or in the long rectangle 4 or in the portion 6 of the cylindrical surface or in the bottom surface 1. The bottom surface 1 and the top surface 2 once again are congruent, are oriented parallel to one another and each have the shape of a rectangle, one longer side of which is adjoined by a circle segment. A second opening 8 is provided approximately centrally in the rectangle (measured along the rectangle 4), namely close to the long rectangle 4 of the lateral surface 3 (in any event closer to the edge where the top surface 2 meets the long rectangle 4 than to the circle segment of the top surface 2). The second opening 8 is located at a distance of approximately two to three times its diameter away from the edge where the top surface 2 meets the long rectangle 4. The circle segment of the bottom surface and top surface 1, 2 has approximately half the width of the rectangle of the bottom surface and top surface 1, 2. This width is measured from left to right in FIGS. 11-13. The second opening 8 is located here in the left-hand third of the imaginary rectangle of the top surface 2, see the bottom part of FIG. 13. Two so-called first openings 7 are located one on each side of the so-called second opening 8, namely at an equal distance from the second opening 8. All three openings 7, 8 are located on a straight line which runs parallel to the long edge of the imaginary rectangle of the top surface 2 or are located parallel to the edge where the top surface 2 meets the long rectangle 4 of the lateral surface 3 or are located normal to the plane of symmetry of the capsule casing, which runs along the dash-dotted line in FIG. 13. The first openings 7 are each located closer than the second opening 8 to the edge formed by the top surface 2 and the short rectangle 5. Each first opening 7 is at the same distance from the edge where the top surface 2 meets the long rectangle 4 and from the edge where the top surface 2 meets the short rectangle 5, here at a distance of approximately two to three times the diameter of the openings 7, 8. Here, all of the openings 7, 8 have the same diameter of approximately 1-1.5 mm.

Figure 13:
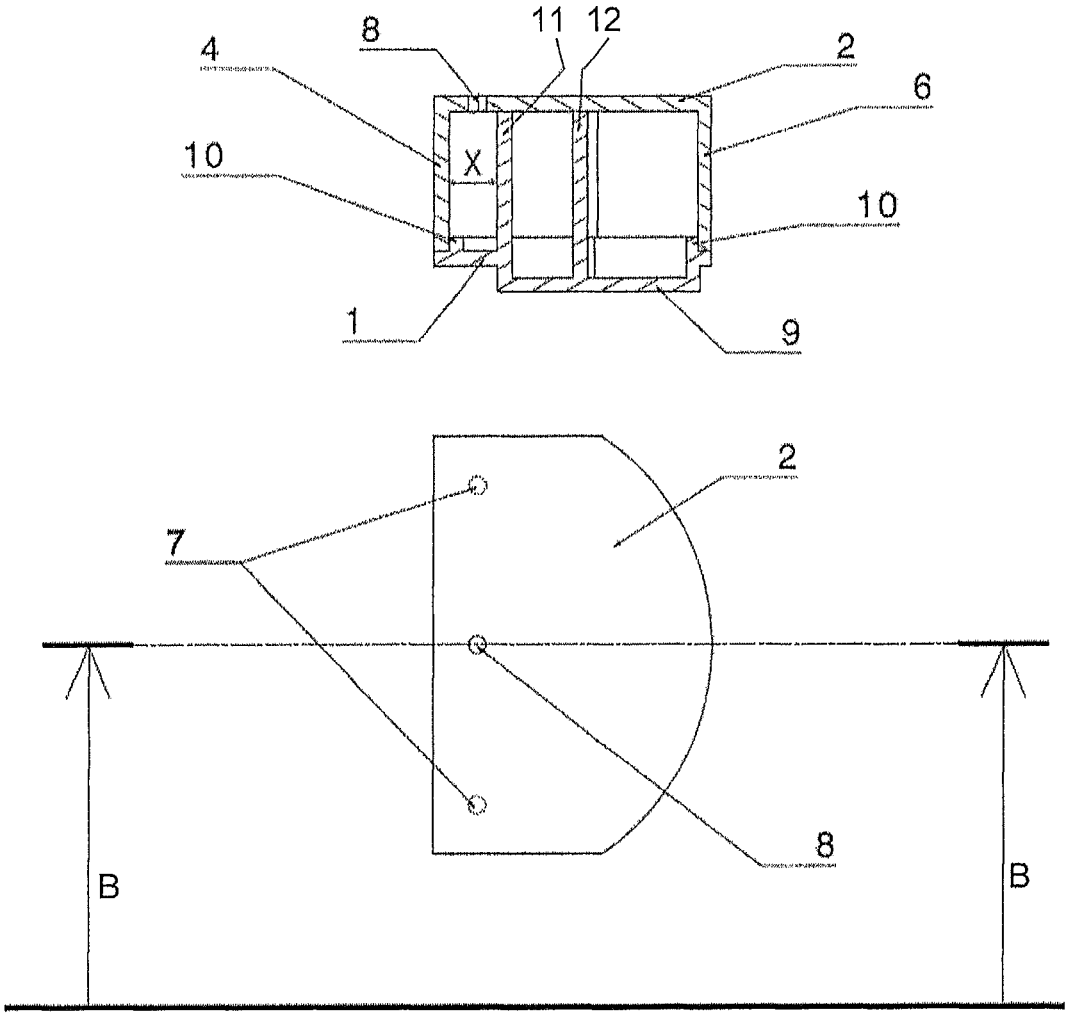
FIG. 13 shows a plan view of a capsule and a sectional view of the capsule of FIG. 11 along the section line B-B, with internal structures.
Figure 16:
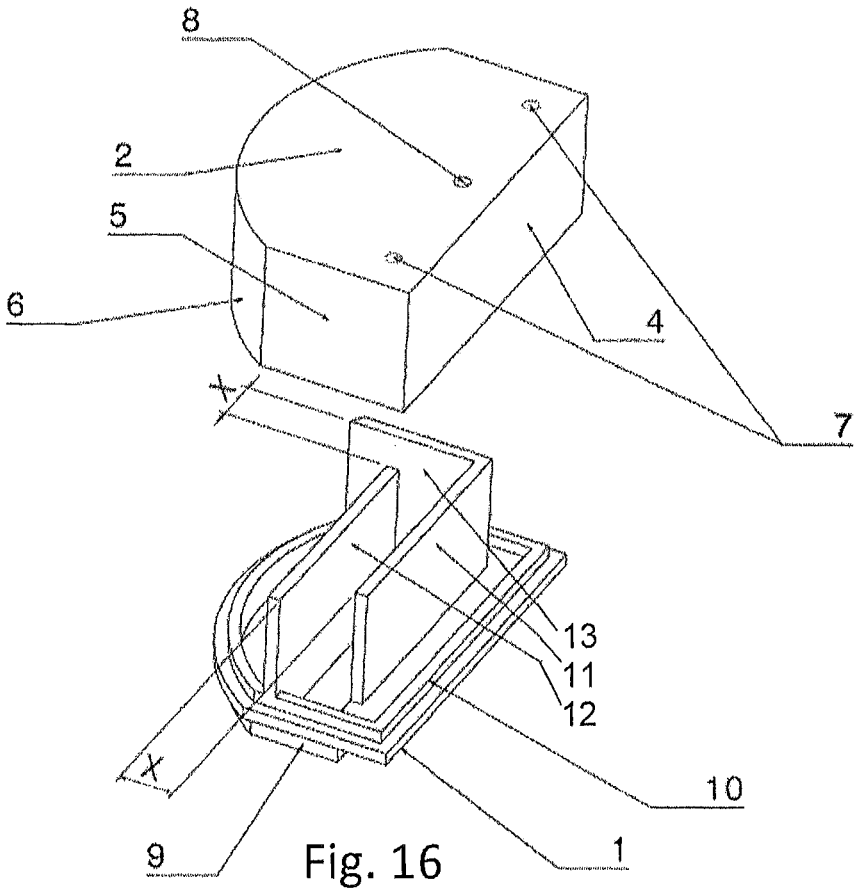
FIG. 16 shows an axonometric view of an open capsule of FIG. 11, with internal structures.
Figure 17:
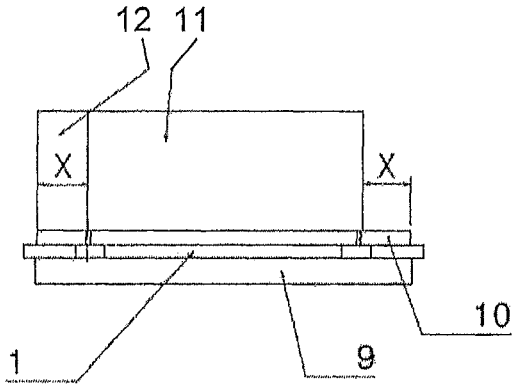
FIG. 17 shows a rear view of a lower part of a capsule of FIG. 16.
Figure 18:
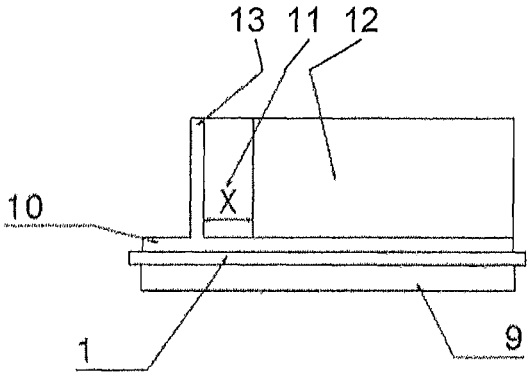
FIG. 18 shows a front view of a lower part of a capsule of FIG. 16.

The top part of FIG. 13 contains a sectional view of one variant of the second capsule with internal structures 11, 12 which are analogous to those of FIG. 9. FIGS. 16-18 also relate to this variant with internal structures, which is similar to the variant of the first capsule with internal structures as shown in FIGS. 7, 8 and 10. The bottom part of FIG. 13 shows a plan view of the second capsule, which is the same with and without the internal structures of the capsule.

Figure 14:
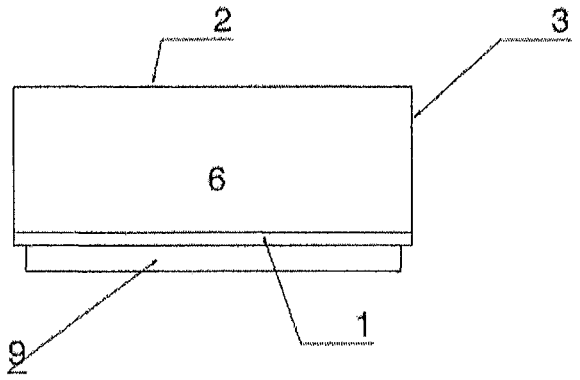
FIG. 14 shows a front view of the capsule of FIG. 11.
Figure 15:
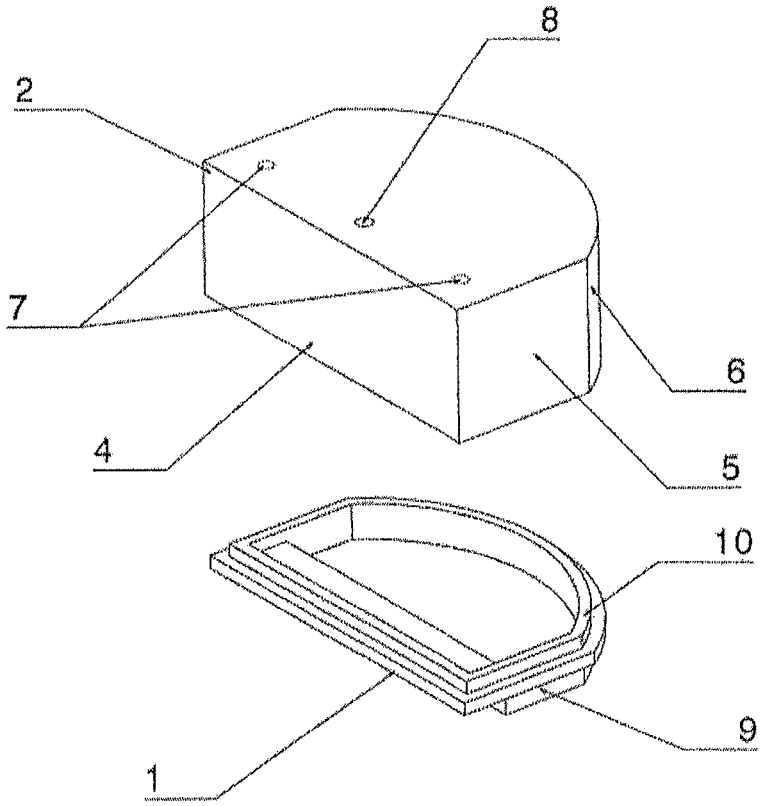
FIG. 15 shows an axonometric view of an open capsule of FIG. 11, without internal structures.

FIG. 14 relating to the second capsule corresponds to FIG. 4 of the first capsule and applies both to the variant with and also to the variant without internal structures. FIG. 15 shows the variant of the second capsule without internal structures. FIG. 15 corresponds to FIG. 6 for the first capsule.

Figure 19:
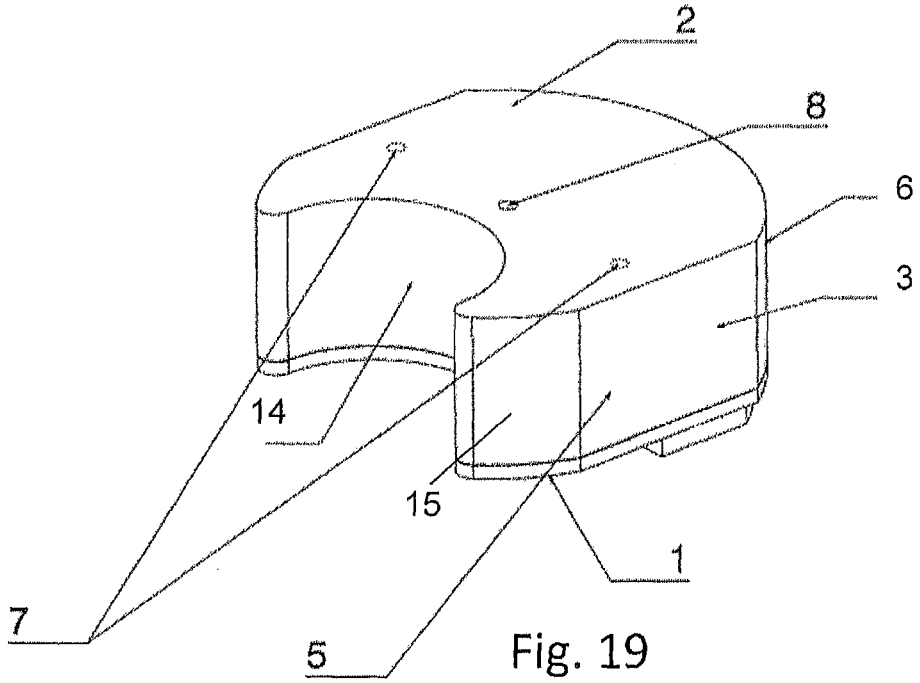
FIG. 19 shows an axonometric view of a third capsule according to the invention.
Figure 20:
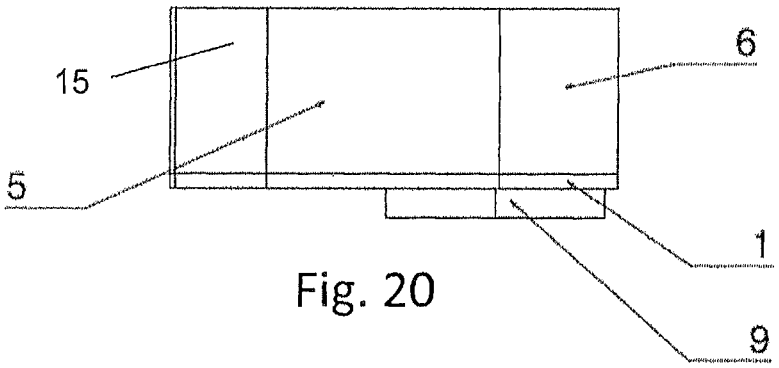
FIG. 20 shows a side view of the capsule of FIG. 19.

FIG. 19 shows a third capsule according to the invention, which—like the second capsule in FIGS. 11-18—has a total of three openings, all of which are located in the top surface 2. In the third capsule shown in FIGS. 19-26, no openings 7, 8 are provided in the lateral surface 3 or in the bottom surface 1.

The capsule casing of the third capsule is also substantially (apart from the base 9) configured as a straight prism, having a bottom surface 1, a top surface 2, and a lateral surface 3 joining said surfaces. The bottom surface 1 and the top surface 2 are congruent, are oriented parallel to one another and each have approximately the shape of a crescent. The lateral surface 3 is normal to the bottom surface and top surface 1, 2 and consists of an outwardly curved portion 6 of a cylindrical surface, of two short rectangles 5, of an inwardly curved portion 14 of a second cylindrical surface and of two further portions 15 of a third cylindrical surface. The outwardly curved portion 6 has a larger radius than the inwardly curved portion 14. Said two portions substantially define the crescent shape. The radius of the two portions 15 is in this case even greater than that of the portion 6, but the radius could of course also be the same, and this would then correspond to the ideal crescent shape, or else smaller. The mid-point of the radius of portion 6 is located within the capsule. The length of the portion 6 in the circumferential direction of the lateral surface 3 corresponds to approximately 110° of the circular arc length of the portion 6. The portion 6 is adjoined on each side by a short rectangle 5. The two rectangles 5 are parallel to one another and are normal to the straight line on which the openings 7, 8 are located. The two rectangles 5 each cut off an identical-sized sector from the imaginary ideal crescent. Each rectangle 5 is adjoined by a portion 15 that merges in each case into the portion 14 via a rounded corner. In the circumferential direction of the lateral surface 3, the portion 14 here has the length of a semicircle (see FIG. 21).

The outwardly curved portion 6 of the capsule could be supported against a correspondingly shaped inner wall of the closure cap. The portions 15 and/or the portion 14 could also be supported against a correspondingly shaped inner wall or against correspondingly shaped internal structures of a closure cap. In particular, the portion 14 is shaped in such a way that it is placed around or surrounds a valve or a mouthpiece of the closure cap.

Figure 21:
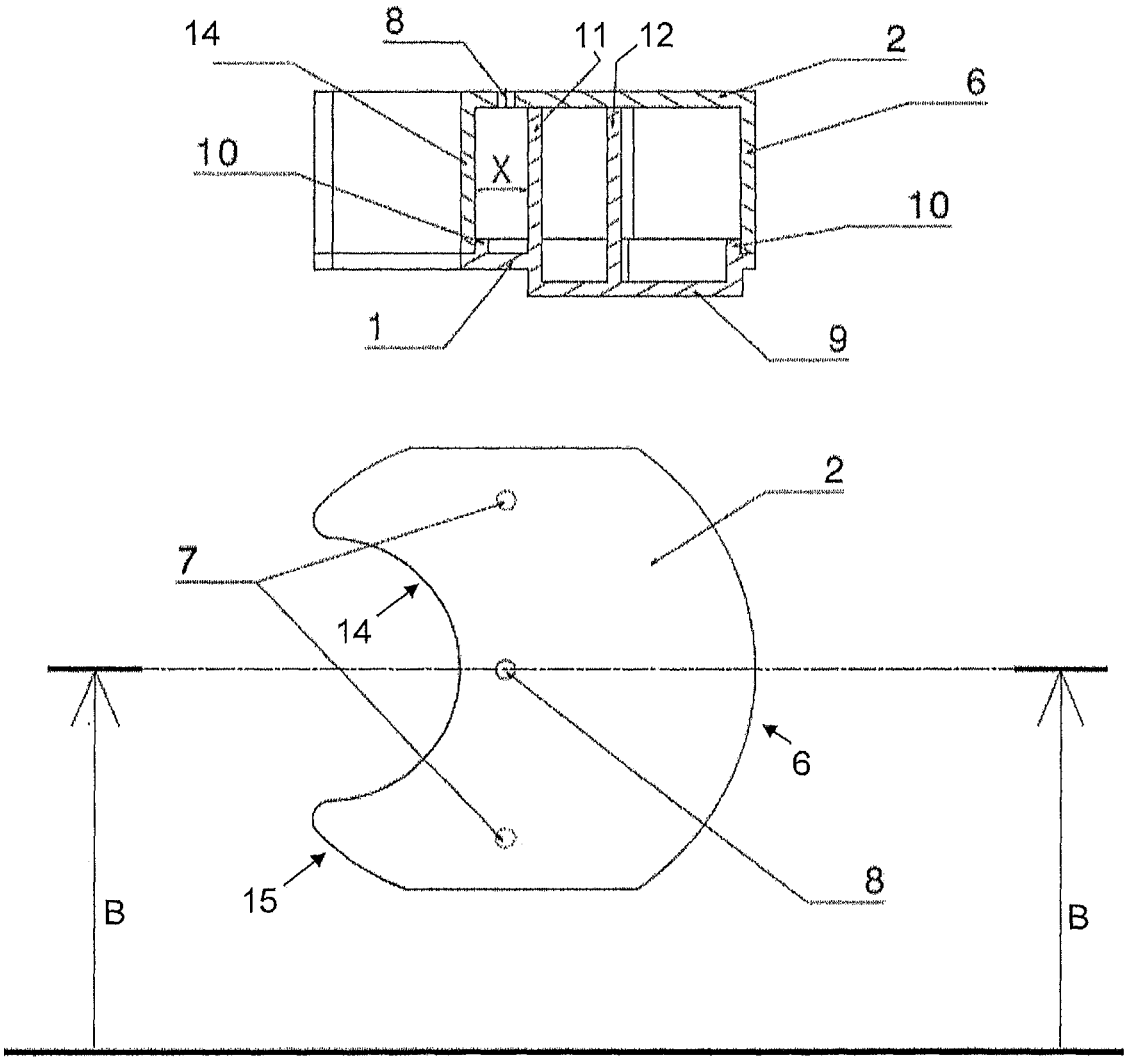
FIG. 21 shows a plan view of a capsule and a sectional view of the capsule of FIG. 19 along the section line B-B, with internal structures.
Figure 22:
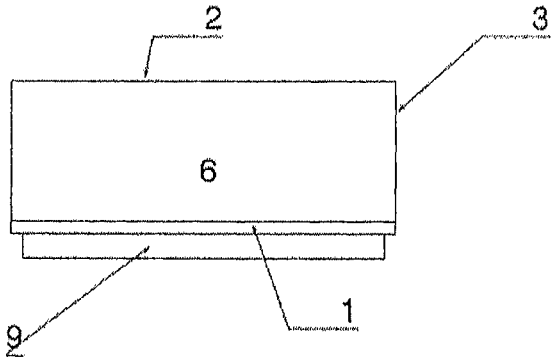
FIG. 22 shows a front view of the capsule of FIG. 19.
Figure 23:
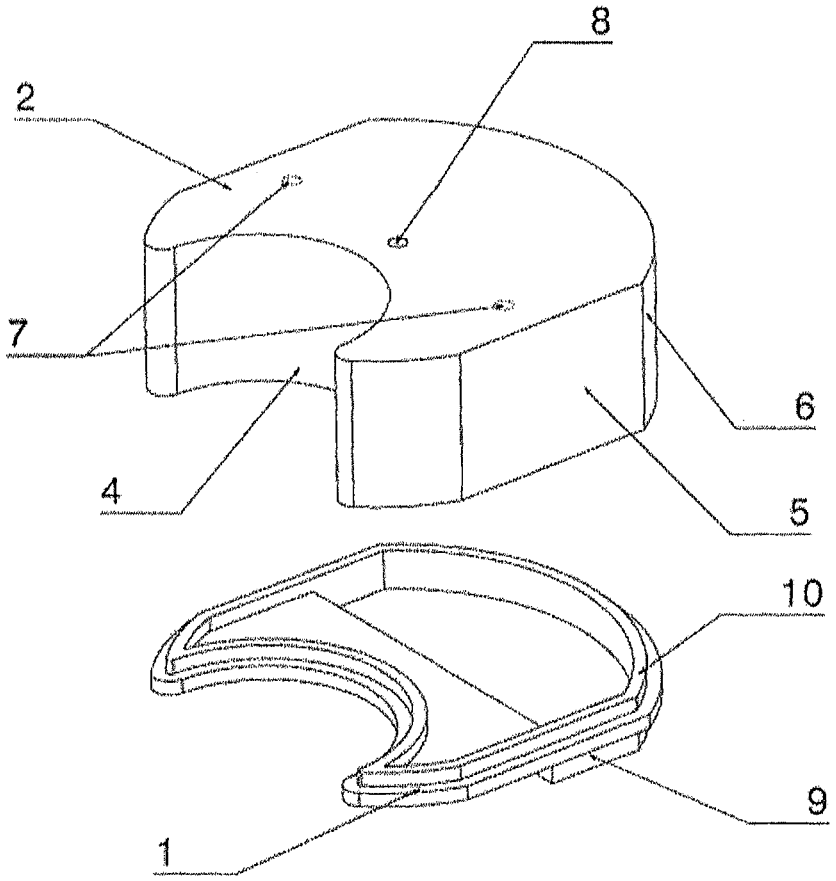
FIG. 23 shows an axonometric view of an open capsule of FIG. 19, without internal structures.

The capsule casing of the third capsule is symmetrical in relation to the dash-dotted line in FIG. 21. If the length of the capsule in FIG. 21 is measured from left to right, parallel to the dash-dotted line, from a rounded tip to the apex of the portion 6, this length is approximately equal to the width, measured in FIG. 21 as the distance between the two rectangles 5.

The openings 7, 8 in FIGS. 19-26 are of equal size and are circular, having a diameter of approximately 1-1.5 mm. In the top surface 2, a single second opening 8 is provided approximately centrally, that is to say on the dash-dotted line which represents the plane of symmetry of the capsule. Said second opening is located close to the portion 14, in this case at a distance therefrom of approximately two to three times the diameter of the opening 8. In each case a so-called first opening 7 is located on either side of the second opening 8 on a straight line normal to the dash-dotted line, namely at an equal distance from the second opening 8 and close to the rectangles 5, that is to say once again at a distance of two to three times the diameter of the opening 7 away from the edge of the rectangle 5.

Figure 24:
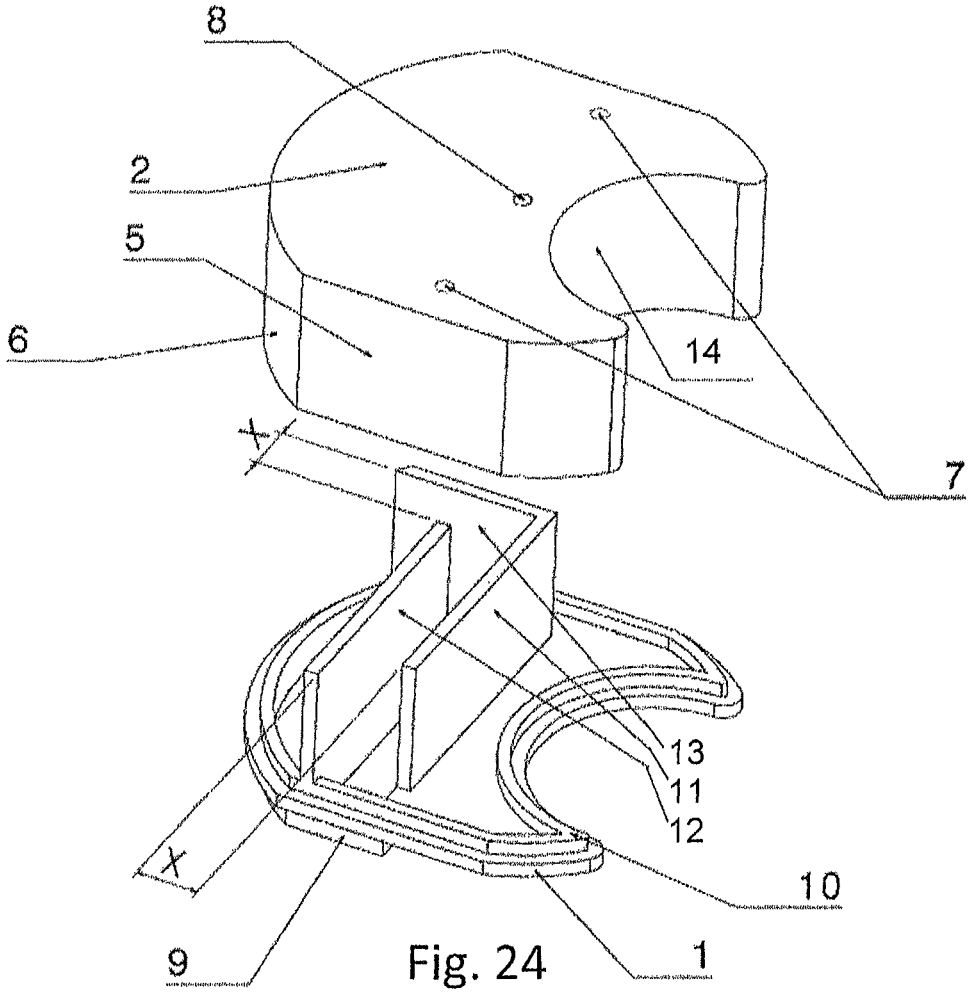
FIG. 24 shows an axonometric view of an open capsule of FIG. 19, with internal structures.
Figure 25:
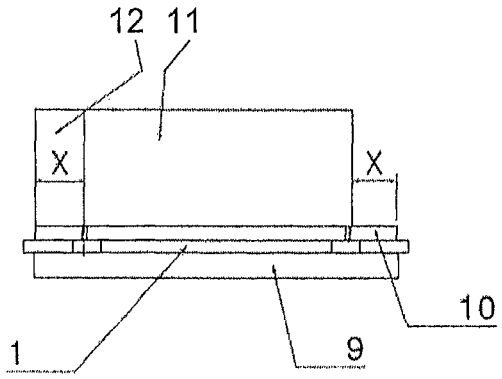
FIG. 25 shows a rear view of a lower part of a capsule of FIG. 24.
Figure 26:
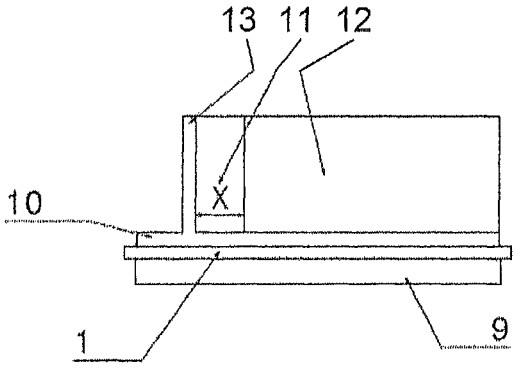
FIG. 26 shows a front view of a lower part of a capsule of FIG. 24.

The variant of the third capsule with internal structures 11, 12, 13 is shown in FIGS. 21, 22 and 24-26. Here, the internal structures 11, 12, 13 correspond to the internal structures in FIGS. 7-10 of the first capsule, and the capsule casing of the third capsule having the portions 6 and the short rectangles 5 is also substantially identical to the corresponding elements of the first capsule. In FIG. 25, the bottom surface 1 can be seen from the rear, that is to say from the right in FIG. 24. In FIG. 26, the bottom surface 1 can be seen from the front, that is to say from the left in FIG. 26. The top part of FIG. 21 is a sectional view of the capsule along the section line B-B at the bottom of FIG. 13. FIG. 24 shows the open capsule.

The internal structures consist of three flat walls 11-13. Two walls 11, 12 run normal to the dash-dotted plane of symmetry of the capsule casing in the plan view at the bottom of FIG. 21. One wall 13 runs normal to the other two walls 11, 12 and adjoins the wall 11 at a right angle. The wall 11 is arranged at a very small distance x from the portion 14. It is shorter than the connection between the two rectangles 5, namely likewise by approximately the distance x at both sides, and is arranged centrally in relation to the plane of symmetry. Here, the wall 11 forms a straight continuation of the wall of the base 9. The wall 11 is so high that, in the closed stated of the capsule, it extends as far as the top surface 2.

The wall 12 is arranged parallel to the wall 11, inside the wall 11 and approximately at a distance x therefrom. It is the same width as the wall 11 but is shifted normal to the plane of symmetry of the capsule casing right to the boundary of the bottom surface 1 so that the wall 12 in the closed state of the capsule extends as far as the lateral surface 3, namely as far as the short rectangle 5. The wall 12 is so high that, in the closed state of the capsule, it extends from the bottom surface 1, more precisely the bottom surface of the base 9, to the top surface 2.

The wall 13 is arranged normal to the wall 12, approximately at a distance x therefrom, and adjoins the wall 11 at a right angle. The wall 13 is so wide that the wall 13 in the closed state of the capsule extends as far as the lateral surface 3, namely as far as the curved portion 6. The wall 13 is so high that, in the closed state of the capsule, it extends from the bottom surface 1, or the bottom surface of the base 9, to the top surface 2.

The three walls 11-13 thus form a channel having a width that corresponds approximately to the distance x. The channel is closed at the top by the top surface 2 and at the bottom by the bottom surface 1 or the base 9 thereof. Said channel has the form of a labyrinth or two meanders and, in the closed state of the capsule, runs first outside of the wall 13 parallel to the wall 13 (between wall 13 and short rectangle 5), then, after changing direction through 90°, outside of the wall 11 along the wall 11 (between wall 11 and portion 14), then, after changing direction through 180°, between the wall 11 and the wall 12, then a further change in direction through 180° takes place along the wall 13, so that the channel finally ends between the wall 12 and the portion 6.

The three openings 7, 8 are located in the region of the channel which runs on the outside along the wall 11, namely between the wall 11 and the portion 14. In this way, the connecting path between the fill liquid in the rest of the fill volume and the openings 7, 8 is lengthened, so that not too much fill liquid can be sucked out of the capsule at the same time, or circulating liquid and fill liquid of the capsule cannot mix too much.

Also in the third capsule shown in FIGS. 19-26, the bottom surface 1 has, inside its outer edge, a lowering toward the outside in the form of a base 9, which runs at a right angle to the rest of the bottom surface 1 in order to insert the capsule into a depression in a closure cap which corresponds to the base 9.

The capsule according to the invention is shown to scale in FIGS. 1-10. The length of the capsule, for instance the length of the long rectangle 4, is 15-45 mm, in particular 20-35 mm. The height of the capsule, measured externally from the base 9 to the top surface 2, is 7-30 mm, in particular 10-25 mm. Correspondingly, the openings 7, 8 have a diameter of approximately 1 mm, usually 1-1.5 mm.

The illustration in FIGS. 11-26 is also shown to scale. The second capsule in FIGS. 11-18 has the same dimensions as the first capsule in FIGS. 1-10. The third capsule shown in FIGS. 19-26 in principle likewise has the same dimension between the short rectangles 5 of 15-45 mm, in particular 20-35 mm, and a height from the base 9 to the top surface 2 of 7-30 mm, in particular 10-25 mm.

In principle, the external shape and size of the capsule depends on the accommodating volume of the closure cap. The volume of the discharging element must not be greater than the accommodating volume of the closure cap.

The rate and duration of discharge of the fill liquid into a liquid circulating around the capsule can be adjusted via the shape of the openings 7, 8, the size of the openings 7, 8, the shape and the material of the capsule, and the viscosity of the liquid with which the capsule is filled.

In the illustrated exemplary embodiments, the bottom surface 1, the base 9 thereof, the lateral surface 3 and the top surface 2 have the same wall thickness. The wall thickness is approximately 0.5 to 1.5 mm, in particular 0.7 to 1.2 mm.

For reasons of hygiene, suitable means must be provided for delivering the filled capsules to the end user, which means prevent the ingress of dirt into the capsule or the leakage of fill liquid from the capsule. For instance, the capsule could be wrapped with a film, and/or the openings 7, 8 could be closed by means of adhesive strips.

LIST OF REFERENCE SIGNS

1 bottom surface
2 top surface
3 lateral surface
4 long rectangle
5 short rectangle
6 portion of a cylindrical surface
7 first opening
8 second opening
9 base
10 web
11 wall (internal structures)
12 wall (internal structures)
13 wall (internal structures)
14 portion of a second cylindrical surface
15 portion of a third cylindrical surface
x distance from wall 11
A closure cap

The invention claimed is:

1. A discharging element for discharging substances into a liquid, wherein the discharging element is in the form of a capsule having a capsule casing comprising a closed bottom surface, a top surface, and a closed lateral surface joining the bottom surface and the top surface, wherein the capsule casing (1-3) encloses a fillable volume for substances to be discharged, the capsule casing is made of a liquid-tight material and has at least one first opening (7) and at least one second opening (8) arranged in the top surface and no openings to the fillable volume arranged in the bottom surface or in the lateral surface, wherein the first and second openings are connected to one another via the fillable volume, wherein the first opening (7) and the second opening (8) are arranged in such a way that, when liquid flows around the capsule, a greater flow velocity is present at the first opening (7) than at the second opening (8), and wherein the liquid draws a liquid substance out of the capsule by utilizing the dynamic pressure, and mixes therewith, wherein the capsule is suitable for being arranged in a closure cap which closes a liquid-filled container, and for having liquid from the container flow around the capsule as a result of tilting of the container, wherein the first opening and the second opening (7, 8) have a diameter of 0.001-3 mm, and wherein the fillable volume contains substances to be discharged which are in the form of a liquid.

2. A unit comprising a closure cap for a liquid container and the discharging element according to claim 1, wherein the discharging element is arranged in the closure cap.

3. A unit comprising a closure cap and a discharging element for discharging substances into a liquid, wherein the discharging element is in the form of a capsule having a capsule casing, wherein the capsule casing (1-3) encloses a fillable volume containing substances to be discharged in the form of a liquid, wherein the capsule casing comprises a closed bottom surface without an opening to the fillable volume, a top surface, and a closed lateral surface without an opening to the fillable volume joining the bottom surface and the top surface, wherein the capsule casing is made of a liquid-tight material and has at least one first opening (7) and at least one second opening (8) which are arranged in the top surface in such a way that, when liquid flows around the capsule, a greater flow velocity is present at the first opening (7) than at the second opening (8), and the liquid draws a liquid substance out of the capsule by utilizing the dynamic pressure, and mixes therewith, wherein the first opening and second opening are connected to one another via the fillable volume, and wherein the discharging element is arranged in the closure cap.

4. The unit according to claim 2, wherein a top surface (2) of the capsule is directed toward an outlet opening of the closure cap.

* * * * *